US006221233B1

(12) United States Patent
Rendall

(10) Patent No.: US 6,221,233 B1
(45) Date of Patent: Apr. 24, 2001

(54) ALUMINUM PRODUCTION UTILIZING POSITIVELY CHARGED ALUMINA

(76) Inventor: John S. Rendall, 4301 Altura NE, Albuquerque, NM (US) 87110

( * ) Notice: Subject to any disclaimer, the term of this patent is extended or adjusted under 35 U.S.C. 154(b) by 0 days.

(21) Appl. No.: 09/264,303

(22) Filed: Mar. 8, 1999

(51) Int. Cl.[7] ..... C25C 3/08; C01F 1/00; C01F 7/02

(52) U.S. Cl. ..... 205/372; 205/378; 205/392; 423/127; 423/128; 423/626; 423/425

(58) Field of Search ..... 205/372, 392; 423/127, 128, 395, 495, 556, 626

(56) References Cited

U.S. PATENT DOCUMENTS

| | | | | |
|---|---|---|---|---|
| 4,592,812 | | 6/1986 | Beck et al. | 204/67 |
| 4,865,701 | | 9/1989 | Beck et al. | 204/67 |
| 5,006,209 | | 4/1991 | Beck et al. | 204/67 |
| 5,019,360 | * | 5/1991 | Lehto | 423/127 X |
| 5,279,715 | | 1/1994 | LaCamera et al. | 204/64 R |
| 5,284,562 | | 2/1994 | Beck et al. | 204/243 R |
| 5,378,325 | | 1/1995 | Dastolfo, Jr. et al. | 204/66 |
| 5,415,742 | | 5/1995 | LaCamera et al. | 204/1.11 |
| 5,498,320 | | 3/1996 | Rendall | 205/385 |
| 5,505,823 | | 4/1996 | Rendall | 205/354 |
| 5,720,868 | * | 2/1998 | Rendall et al. | 205/372 |

OTHER PUBLICATIONS

Ernest W. Dewing, "The Thermochemistry of Aluminum Smelting", pp. 341–350, Proc. of the Savard/Lee Intl. Symp. on Bath Smelting, The Materials and Metals Society (Canada), 1992. (No Month).

Karl Wefers Chanakya, "Oxides and Hydroxides of Aluminum", Alcoa Laboratories, 1987. (No Month).

* cited by examiner

*Primary Examiner*—Donald R. Valentine
(74) *Attorney, Agent, or Firm*—Thomas E. Schatzel; Law Offices of Thomas E. Schatzel, A Prof. Corp.

(57) ABSTRACT

The smelting of aluminum from alumina in the Hall-Heroult process can be dramatically improved by lowering power consumption and in the use of carbon free anodes by using a feed of positively charged alumina. Laboratory experiments have shown that the apparent solubility and reactivity of alumina in molten fluoride baths is surprisingly increased by altering the negatively charged aluminum hydroxide $Al(OH)_4^-$ particles, at about pH of nine, to positively charged particles containing $Al^{+++}$ with a pH of less than two, by using acid solutions. The alumina thus produced is referred to as $Al^{+++}$ alumina, or positively charged alumina. In particular, sulfuric acid is used to convert aluminum hydroxide using the Bayer process to a family of basic aluminum sulfates, $3Al_2O_3.4SO_3.9H_2O$, which are dehydrated and calcined to produce $Al^{+++}$ alumina.

17 Claims, 5 Drawing Sheets

400
Al(OH)3
H2SO4
404
406
acid recycle
recycle liquor
reaction 200°C
402
410
408
condenser
414
pressure letdown 100°C
412
416
solid-liquid separation
418
option for purge
420
H2O
washing solids
422
424
440
428
drying solids
426
natural gas
condenser
430
438
natural gas
make-up sulfur
calcine 950°C
SO2/SO3
acid plant
432
436
434
Al2O3 storage

ALUMINUM PRODUCTION UTILIZING POSITIVELY CHARGED ALUMINA

BACKGROUND OF THE INVENTION

1. Field of the Invention

The present invention relates generally to the smelting of aluminum metal from alumina, and more specifically to using acid to convert aluminum hydroxide starting materials into positively charged alumina for increased solubility in a Hall-Heroult electrolyte.

2. Description of the Prior Art

Practically all the aluminum metal smelted from raw materials is made by the Hall-Heroult process invented in the nineteenth century. See, Ernest W. Dewing, "The Thermochemistry of Aluminum Smelting", pp. 341–350, Proc. of the Savard/Lee Intl. Symp. on Bath Smelting, The Materials and Metals Society (Canada), 1992. Such process uses very high electrical currents to electrolyze alumina, $Al_2O_3$, which is dissolved in an electrolyte of molten cryolite, $Na_3AlF_6$, at temperatures of 945° C. to 975° C. But such high temperatures can cause the carbon in the anodes to burn with the air rather than contribute to the removal of oxygen from the alumina.

A consumable carbon anode is used in the Hall-Heroult process with a gross cell cathode-anode voltage of about 4–5 volts. The typical ohmic resistance of the electrolyte is about 0.4 ohms/cm, and a typical current density of 0.75 amps/cm$^2$ produces a voltage drop of about 0.3 volts/cm$^{-1}$. The ohmic drop is thus about 1.2–1.5 volts, the reversible EMF is about 1.2 volts, the kinetic overpotential is about 0.5 volts, and the gas-bubble layer resistance under the anode drops about 0.15 volts. This gives a total of about 3.2 volts that is dropped in the inter-electrode gap. About another volt is lost within the anode and cathode electrodes and their busbar connections. Typically, over thirteen kilowatts of electrical power per kilogram of aluminum metal is needed, and this will result in about 0.45 kilograms of carbon being consumed from the carbon anode.

A typical modern smelting cell will draw about 200,000 amperes and the electrical energy consumed in the cells contributes to both the Gibbs energy needed by the chemistry and the ohmic heating that keeps the electrolyte hot. The overall reaction approximates to $2Al_2O_3+3C+energy=4Al+3CO_2$.

Alumina has been used as the primary feed material in the electrolytic smelting of aluminum metal for over a hundred years. Bauxite, in particular, is the raw material that is universally used. Worldwide, over forty million tons per year of smelting alumina is produced and this, in turn, yields twenty million tons of aluminum metal. The Bayer process is the principle method now used to convert bauxite to alumina, and such process depends on a caustic (e.g., NaOH) to leach the bauxite. Such use of a caustic yields negatively charged alumina. The present inventor, John S. Rendall, has determined that such negative charges impair the dissolution of alumina (and the rate thereof) in the cell electrolyte, and require more electrical power to drive the electrolysis than would be required if such charges were positive or neutral.

Alumina that is good enough to be used for the electrolytic smelting of aluminum is typically referred to as "cell-grade alumina". One of the principle characteristics important to cell-grade alumina is its relative solubility in molten fluoride salt electrolyte. Universally, such molten fluoride salt electrolytes are heated to 950° C. just to raise the solubility to a approximately four percent by weight.

The optimal alumina reactivity and the optimum electric voltage needed to produce a useful electrolytic dissociation of the alumina has been the subject of a great deal of scientific study. Just about all electrolytic cells use engineered alumina precipitated as a hydroxide from caustic solutions of approximately nine pH. The low degree of alumina dissolution and the rate thereof in the molten bath electrolyte is an on-going problem. About four percent alumina, $Al_2O_3$, by weight, is considered the upper limit at 950° C. The usual way that alumina is fed into cells produces a lot of dust. Such alumina feed is also used in fluid beds to capture fluoride emissions. The voltage drop of four to six volts across a conventional electrolytic cell includes the bath resistance, the electrode resistance of two electrodes, as well as the energy of electrolysis ameliorated by the electrolytic formation of $CO_2$.

The dissolution of the alumina in the molten bath is so low, it requires careful and sophisticated replenishment. At 750° C. the dissolution and rate thereof of the alumina is less than one percent and cannot be used at this temperature. Only six percent, by weight, is usually possibly at 950° C. Over-feeding of alumina will create a bottom sludge that can cover and electrically isolate the molten aluminum cathode surface. This will cause a reduction in the electrical current that can be induced due to the increased voltage required, and thereby cause the cell to freeze up because it cannot produce enough electrical heating. At under one percent, by weight, alumina in the bath causes an increase in the voltage drop that occurs in the carbon anode and reduces the power input (amps) causing the cell to freeze. This localizes heat generation there and adversely affects the crust seal at the top of the cell. This localized heating at the carbon anode can also be responsible for the production of carbon fluoride gases.

In the preparation of alumina for use in cells, any alumina that precipitates as aluminum hydroxide from a sodium aluminate solution is usually considered to comprise negatively charged ions, $Al(OH)_4^-$. Such precipitation is usually done at a pH of about nine, and a temperature of about 80° C. The negatively charged ions are produced by caustic leaching of bauxite, and contribute to a clustering of crystals into larger particles. The bonding mechanisms in these clusters consumes most of the negative ionic charges, and the overall negative charge is almost completely neutralized. See, Karl Wefers Chanakya, "Oxides and Hydroxides of Aluminum", Alcoa Laboratories, 1987. In any event, an intermediate aluminum hydroxide must be aged 24-hours to get the type of alumina that will work well in smelters. The day-old aluminum hydroxide is then dried and calcined at about 1000° C. to produce the desired cell-grade alumina.

SUMMARY OF THE PRESENT INVENTION

An object of the present invention is to provide a method for the production of alumina that is suitable in the low-temperature smelting of aluminum by electrolysis.

Another object of the present invention is to provide a method for more efficient smelting of aluminum in a Hall-Heroult cell.

Briefly, a method embodiment of the present invention includes the smelting of aluminum from alumina in the Hall-Heroult process by using a feed of "positively charged" alumina. Laboratory experiments have shown that the apparent solubility and reactivity of alumina in molten fluoride baths is significantly increased by altering the negatively charged aluminum hydroxide $Al(OH)_4^-$ particles, at about pH of nine, to positively charged particles containing $Al^{+++}$ with a pH of less than two, by using acid solutions. The alumina thus produced is referred to as $Al^{+++}$ alumina, or positively charged alumina. In particular, sulfuric acid is used to convert aluminum hydroxide using the Bayer process to a family of basic aluminum sulfates—$3Al_2O_3 4SO_3 9H_2O$, which is in turn dehydrated and calcined to produce the $Al^{+++}$ alumina.

An advantage of the present invention is that an environmentally friendly process is provided for producing aluminum.

Another advantage of the present invention is that a relatively inexpensive process is provided for the production of positively charged $Al^{+++}$ alumina.

A further advantage of the present invention is that the positively charged alumina reduces or eliminates the power required to achieve actual electrolysis except for the power required for transmission of current through the system.

A still further advantage of the present invention is the ability to operate an electrolytic reduction cell at temperatures around 750° C., which reduces heat losses in comparison to operation at 950° C. and allows for the use of "carbon free" (inert) anodes. In contrast, Bayer alumina is relatively insoluble at 750° C. in molten flouride, while $Al^{+++}$ alumina appears to be soluble at a concentration in excess of four percent at 750° C.

Another apparent advantage of the present invention is that the use of $Al^{+++}$ alumina as the only feedstock in aluminum smelting reduces or eliminates the power needed by a cell to actually break the oxygen free of the aluminum in each alumina molecule.

An advantage of the present invention is that a cell is provided that may be operated at lower temperatures because the $Al^{+++}$ alumina is soluble in the electrolyte at these lower temperatures and alumina produced with caustics is not.

These and other objects and advantages of the present invention will no doubt become obvious to those of ordinary skill in the art after having read the following detailed description of the preferred embodiment that is illustrated in the drawing figures.

IN THE DRAWINGS

DETAILED DESCRIPTION OF THE PREFERRED EMBODIMENTS

Figure 1:
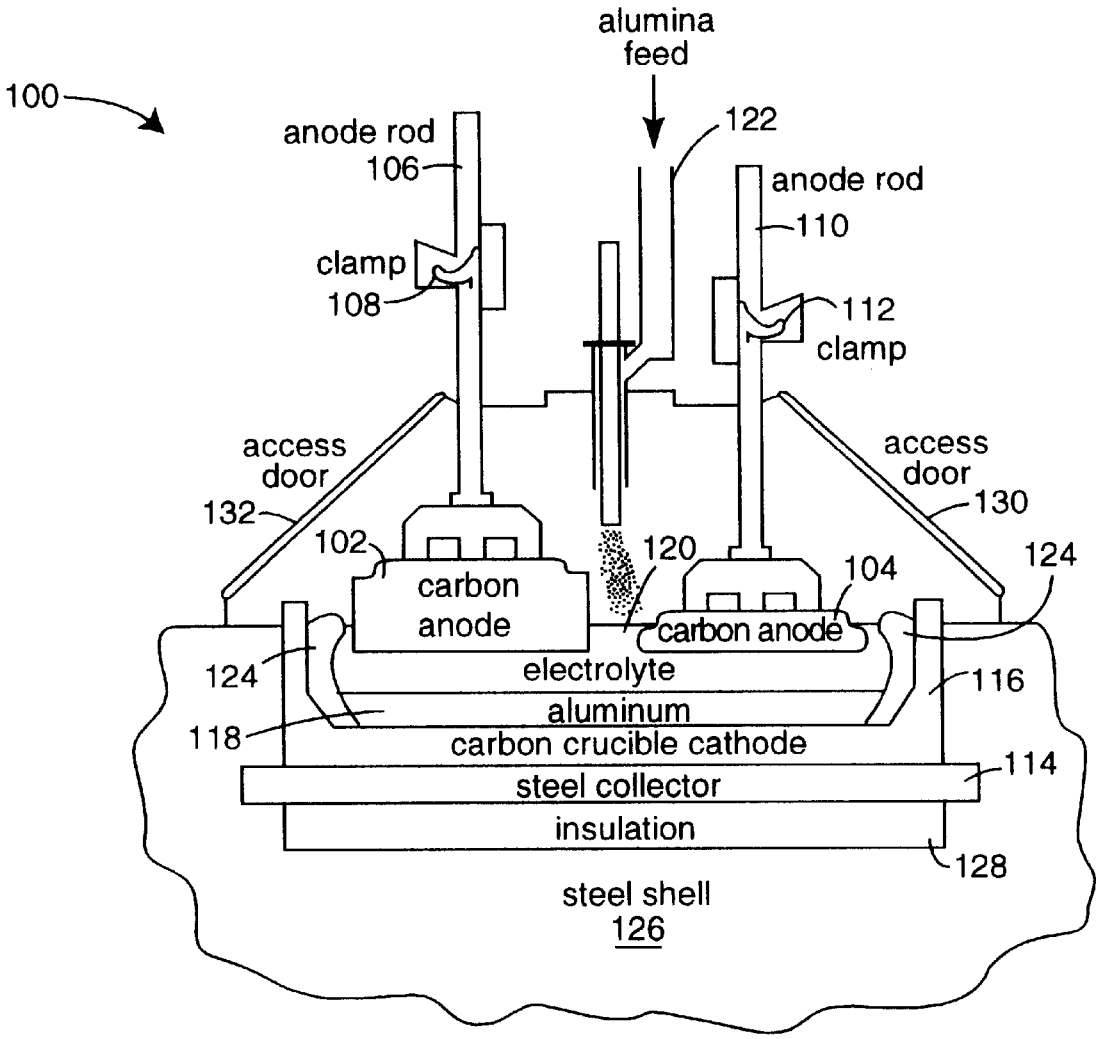
FIG. 1 is a cross sectional diagram of a first cell embodiment of the present invention that includes two consumable carbon anodes and uses a main feed of positively charged alumina.

FIG. 1 illustrates a first cell embodiment of the present invention, and is referred to by the general reference numeral 100. The cell 100 uses two carbon anodes so that aluminum smelting can proceed continuously even though one carbon anode has been consumed and may be electrically turned off for on-line replacement. FIG. 1 shows this as a new carbon anode 102 that was recently replaced and a near expired carbon anode 104. A support 106 and a clamp 108 allow the carbon anode 102 to be lowered to maintain a particular inter-electrode gap as the carbon in the anode is consumed by the smelting process. Similarly, a anode rod 110 and a clamp 112 allow the other carbon anode 104 to also be lowered to maintain its particular inter-electrode gap as its carbon is consumed by the smelting process. A steel current collector bar 114 lies under a cathode 116. A pool of liquid metal aluminum 118 forms in an inter-electrode gap and is drawn off as it is smelted. A pool of molten eutectic fluoride salts including cryolite ($Na_3AlF_6$) 120 is heated to approximately 750° C. by a large electrical current that passes between the anodes and cathode. An alumina feed 122 drops positively charged alumina into the pool of molted cryolite 120. A crust of frozen cryolite 124 usually forms at the outside edges due to heat losses. A steel shell 126 supports the weight of the whole assembly. An insulative liner 128 helps keep the heat generated inside to reduce the amount of electrical energy needed. A pair of doors 130 and 132 provide access to the cell interior.

Figure 2:
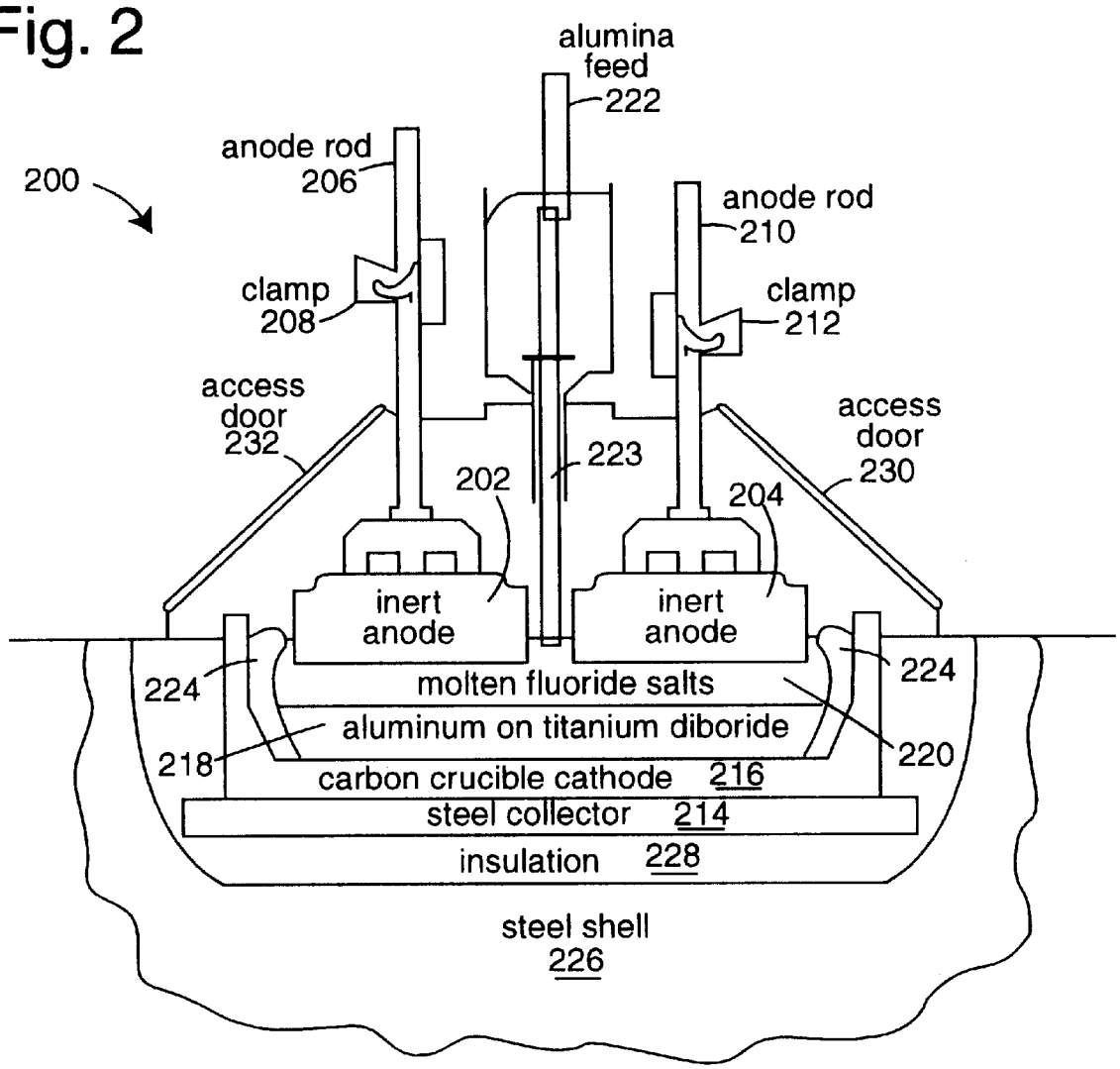
FIG. 2 is a cross sectional diagram of a second cell embodiment of the present invention that includes two inert anodes and a main feed of positively charged alumina.

FIG. 2 illustrates a second cell emodiment of the present invention, and is referred to by the general reference numeral 200. The cell 200 uses a pair of non-consumable inert carbon-free anodes 202 and 204. A support 206 and a clamp 208, and another anode rod 210 and a clamp 212, allow the anodes 202 and 204, respectively, to be lowered to maintain a particular inter-electrode gap. A steel current collector bar 214 lies under a carbon crucible cathode 216. A metal cathode 218 includes a waffle structure of titanium diboride which is wetted by a pool of liquid metal aluminum. A pool of molten fluoride salts 220 is heated to approximately 750° C. by a large electrical current that passes between the anodes 202 and 204 and the collector bar 214. The aluminum smelted from the alumina-electrolyte solution forms in an inter-electrode gap of the anode-cathode and is drawn off as it is smelted.

Very large electrical currents are present in the cell 200 and these induce very strong magnetic fields that can slosh the aluminum around in the cathode 218. The purpose in building the cathode 218 with a waffle structure of titanium diboride is to control such waves. If left out of control, the crests of the waves of liquid aluminum could temporarily short out the cell. Bus bar design ameliorates the problem.

Ordinary cryolite must be mixed with a eutectic partner to lower the melting point low enough to operate as low as 660° C., the melting point of aluminum.

It is critical to the present invention that an alumina feed 222 drop only positively charged alumina into the pool of molten fluoride salts 220. A crust-breaking bar 223 helps to get the alumina feed mixed into the pool of molten cryolite. A rim crust of frozen cryolite 224 usually forms at the outside edges due to heat losses which also protects the lining from air burn and erosion. A steel shell 226 supports the weight of the whole assembly. An insulative liner 228 wraps under and around the crucible to conserve the heat generated inside better than that shown in FIG. 1. A pair of doors 230 and 232 provide access to the cell interior and for maintenance of the anodes.

Figure 3:
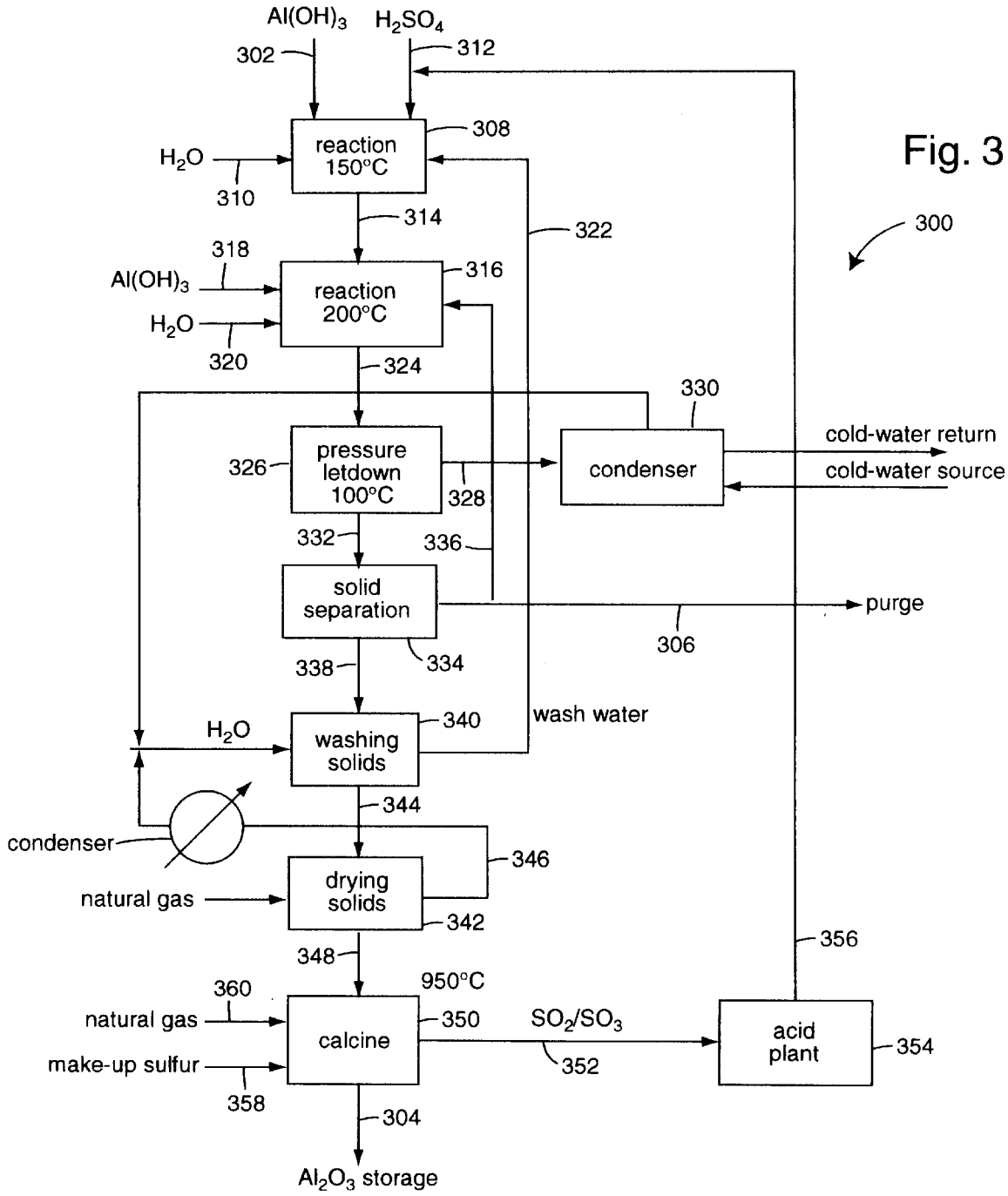
FIG. 3 is a process flow diagram illustrating a first process embodiment for the production of positively charged alumina from aluminum hydroxide.

FIG. 3 represents a process embodiment of the present invention for making the positively charged alumina required in cells 100 and 200 (FIGS. 1 and 2), and is referred to herein by the general reference number 300. The process 300 converts an aluminum hydroxide feed 302 into a positively charged alumina 304 for use in electrolytic smelting of aluminum. The process is, in essence, a "zero-discharge" facility excepting a small purge stream 306 which removes impurities that may have been introduced with the feed stock 302.

The process 300 begins with a reaction step 308 wherein the aluminum hydroxide is fed, either as a wet cake or as a dry powder, with a slurry water 310 and an acid 312 into a pressure cooker. The acid 312 can be sulfuric acid. The temperature is raised to approximately 150° C. to produce an aluminum sulfate in a molten hydrate form. The pressure is held high enough to maintain a liquid state, e.g., 1100 kilo-Pascals. The residence time is between one to ten minutes, and preferably about two minutes.

The molten aluminum sulfate is fed as a slurry 314 to a process step 316 under pressure. A second aluminum hydroxide feed 318 and water feed 320 are added as required to maximize the final product basic aluminum sulfate. The slurry 314 uses a recycle stream 322. In step 316, the temperature is increased to at least 180° C. and not more than 210° C. under the vapor pressure of the reacting mixture, about 1900 kilo-Pascals. The residence time one to five minutes, and usually less than two minutes. A product slurry 324 is transferred to a pressure-letdown process step 326 wherein the pressure is reduced to atmospheric and thus flashes any water. This lowers the temperature from about 200° C. to the atmospheric boiling point, e.g., 100° C. A flashed water flow 328 is condensed in process step 330. A basic aluminum sulfate slurry 332 has a slurry concentration that ranges twenty-five to thirty-five percent and is nominally thirty percent. The slurry 332 is transferred to a solids separation process step 334. Widely available commercial filtration and centrifuge separators may be used to implement the solids separation process step 334. A separated mother liquor 336 is recycled to step 316. The purge 306 comes from the same separator and is used to rid the process of any accumulated impurities. A solid product basic aluminum sulfate flow 338 is transferred to step 340. The solids are washed out with a condensate provided from a solids drying step 342 and the condensing step 330. Such washing may be by any of the usual solids washing equipment in as many stages as necessary for efficient use of water.

A final basic aluminum sulfate moist cake flow 344 has its free moisture removed in step 342 by drying at about 450° C. This also drives off all or part of the waters of hydration associated with the basic aluminum sulfate product. The water vapor 346 produced in the solids drying step 342 is condensed and recycled to step 308 via the washing step 340. Alternatively, the water vapor may be vented to the atmosphere.

A solid product flow 348 is calcined in a step 350 by heating it to approximately 950° C. Conventional calciners may be used, such as rotary drums or fluid flash calciners. A sulfur dioxide and sulfur trioxide flow 352 is produced by the calcination step 350 and forwarded to an acid plant 354 for recycling in a flow 356.

The positively charged alumina flow 304 is discharged through coolers as is conventional for cell-grade alumina. Such positively charged alumina flow 304 is directly useful as the alumina feeds 122 and 222 in FIGS. 1 and 2.

The particle size distribution of the positively charged alumina flow 304 preferably duplicates that produced in the conventional Bayer process. The particle size distribution is typically about fifty percent of so-called Bayer alumina, and the bulk density is about twenty to thirty percent less than that of Bayer alumina. The particle size distribution of the positively charged alumina flow 304 may be optimized by varying the pH of the slurry in step 316 with different amounts of sulfuric acid, higher or lower temperatures, and longer or shorter residence times.

In the step 354, the off-gases from step 350 are processed through a conventional acid plant by: a) lowering the temperature for water vapor and sulfur trioxide adsorption with concentrated sulfuric acid, b) conversion of sulfur dioxide to the trioxide, and c) absorbing such sulfur trioxide in a concentrated sulfuric acid. The resulting sulfuric acid product is recycled in flow 356 to the beginning process step 308. Minor miscellaneous losses of sulfur dioxide can be made up either by burning sulfur provided at an input 358 as part of a fuel input 360 to calcination step 350, or by direct burning as part of the acid plant 354.

Figure 4:
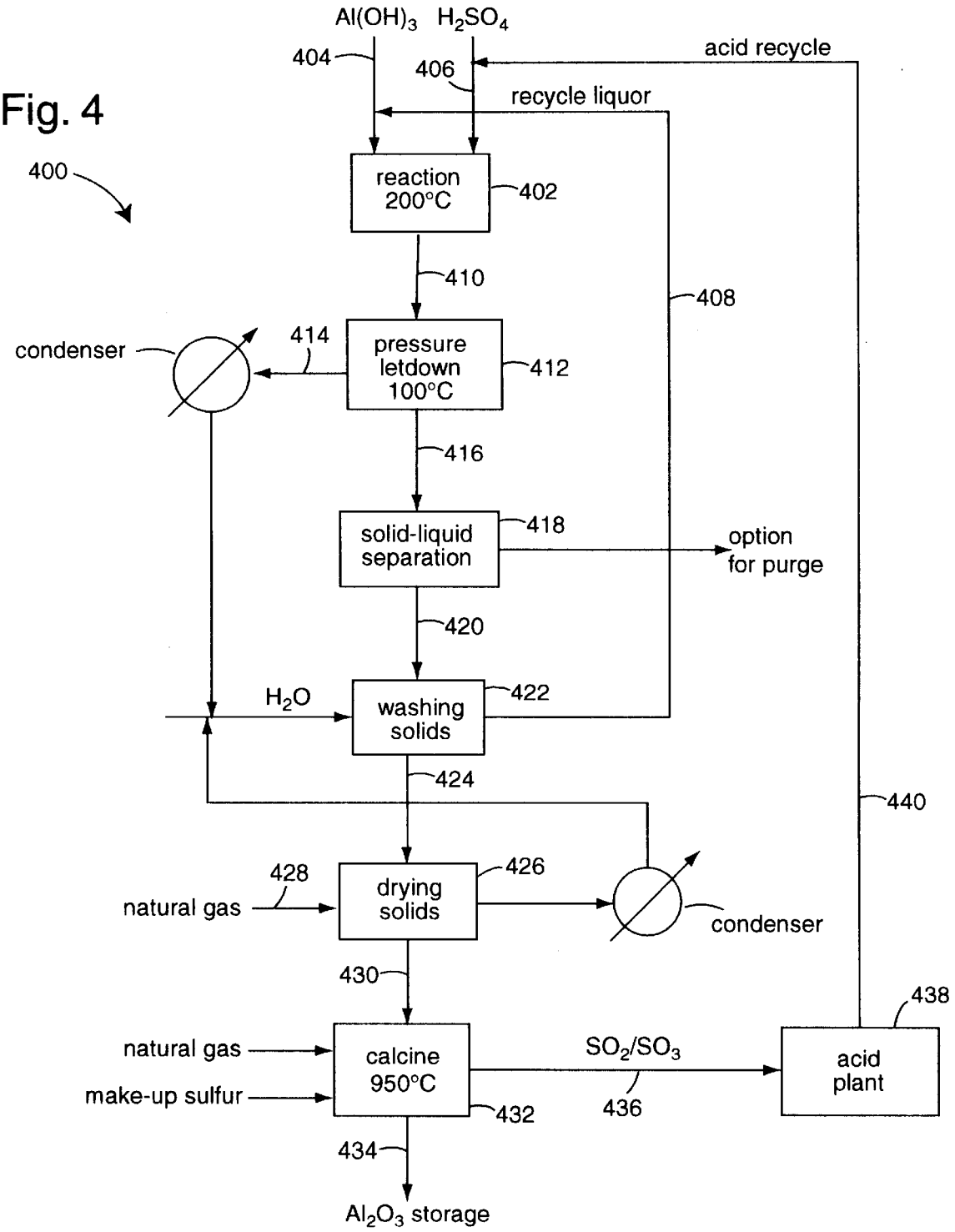
FIG. 4 is a process flow diagram illustrating a second process embodiment for the production of positively charged alumina from aluminum hydroxide.

FIG. 4 represents a process embodiment of the present invention, referred to herein by the general reference numeral 400, that optimizes the particle size distribution for a maximum positive charge on the produced alumina. Process 400 comprises a reaction step 402 for a main feed 404 and an acid input 406. The mixture is cooked in a reactor at a temperature of 170° C. to 230° C., and preferably over 180° C. while maintaining a reaction vapor pressure that generally exceeds 1400 kilo-Pascals. The reactants are maintained in step 402 at a pH of two or less by varying the sulfuric acid feed 406 to the reactor. The main feed 404 comprises aluminum hydroxide in cake or dried form, and is slurried with a recycle liquor 408. The residence time in the reactor of step 402 is generally about two minutes. The residence time may need to be increased considerably when lower sulfuric acid concentrations are associated with higher pH, or when larger particle sizes of aluminum hydroxide feed are needed. The resulting yields of a flow 410 may vary according to the temperature, pH, and residence time elected.

The pressure of flow 410 is let down in a step 412 in single or multiple stages to atmospheric pressure. The temperature generally drops to about 100° C. as a result. The vapor from the pressure letdown flash step 412 is condensed for use as a washing fluid 414. A product slurry 416 is separated into product and mother liquor in a step 418, e.g., by vacuum filtration, pressure filtration, centrifugation, etc. A solid product 420 is then washed in step 422 to remove the last of the mother liquor. Any of the ordinary separation practices currently used in the alumina industry can be used provided the equipment materials of construction are suitable for the acidic environment.

In alternative embodiments of the present invention, the pressure available in step 402 is used to operate a pressurized solid-liquid separation. In such case, the pressure letdown of step 412 may be split to both precede and follow the solid liquid separation of step 418 and the washing of step 422.

A moist solids flow 424 is transferred to a step 426 for drying and dehydration at approximately 450° C. A natural gas input 428 provides the fuel needed for heating. Water vapor may be condensed for use in the washing step 422 or simply vented from the process. A dehydrated product flow 430 is transferred to a step 432 for calcination at approximately 950° C. Alternatively, steps 426 and 432 may be combined. Depending upon the choice of equipment, e.g., rotary drums or fluid flash equipment, the feed 430 may be taken from either step 426, as shown, or step 422.

A product flow 434 following calcination is cooled and made ready for aluminum production in commercial installations. Any off-gas flow 436 from calcination, that includes $SO_2$ and $SO_3$, is transferred to an acid plant step 438 where they are cooled and dried with concentrated sulfuric acid. In step 438, any moisture and $SO_3$ are removed in a drying step. The gases are then passed through a conventional $SO_2$ converter.

The water content of the calciner off-gases to the drying step must be critically controlled in the acid plant 438. Such is essential so as to not exceed the drying capacity of the concentrated sulfuric acid while maintaining acid quality for an acid recycle flow 440. The waste heat of the acid plant step 438, or simple evaporation, may be used to maintain a correct water balance.

Figure 5:
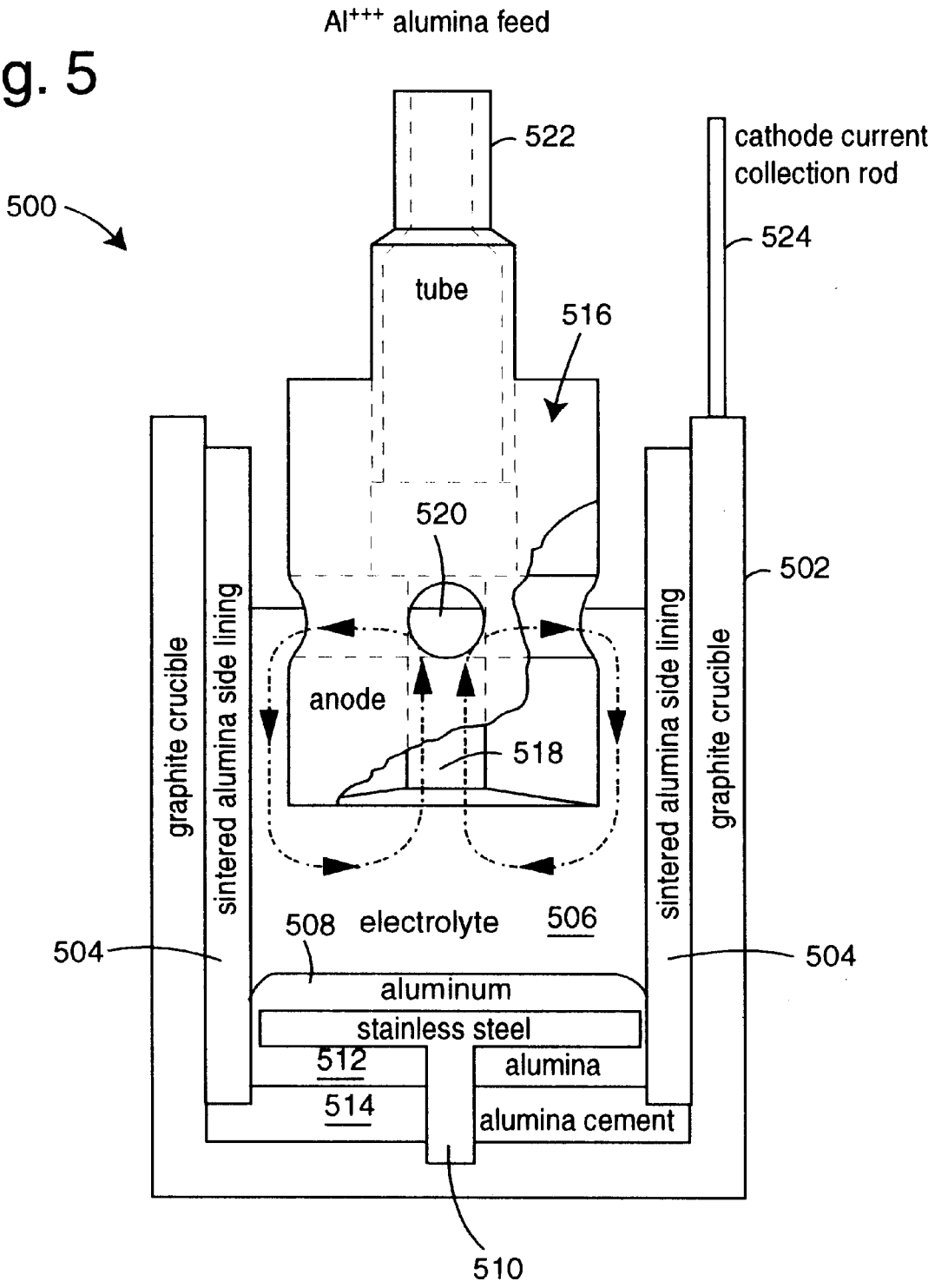
FIG. 5 is a cross section of a laboratory cell taken along a central vertical plane that was used in an experiment which measured the various voltage drops that occur during aluminum smelting.

FIG. 5 represents a laboratory cell 500 that was used to test a bath circulation of positively charged alumina, e.g., aluminas 122, 222, 304, and 434. Such experiments were run at temperatures of 950° C. to 980° C. and the voltage drops across the cell were calculated and measured for the smelting of aluminum. For cell currents of ten to twenty-eight amperes, equal to anode current densities of 0.5 to 1.4 amps/cm$^2$, the only voltage drops that were observed were across the cathode, the anode, and the bath. In one test in particular that lasted for a period of over four hours, no voltage drop at all could be attributed to the actual production of aluminum. The positive charge of the $Al^{+++}$ alumina of the present invention appears to have supplied the energy that is conventionally needed to be electrically applied from an external power source. The "acid-based" alumina of the present invention is now believed to be completely ionized or disassociated in the bath. The $Al^{+++}$ alumina is propelled towards the cathode according to Coulombs Law, at 2.98 coulombs per gram of aluminum.

The laboratory test cell 500 included a graphite crucible 502 that was in the form of a round cylindrical cup about one hundred and ten millimeters tall and about eighty millimeters in diameter. Inside there was placed a sintered alumina side lining 504 that contained a cryolite electrolyte bath 506. A pool of smelted aluminum 508 formed just above a stainless steel current collection plate (cathode) 510. An alumina support 512 and an alumina cement 514 were used to enclose the bottom. An anode 516 was specially designed to circulate the electrolyte bath 506 up through a bottom hole 518 and out through a series of side ports 520. This is represented by arrows on dashed lines in FIG. 5. The diameter of the anode was about 50.86 millimeters and the bottom hole and side ports were about ten to fifteen millimeters in diameter. A steel tube 522 was used to support the anode and feed in positively charged alumina. A cathode collection rod 524 was connected along with the anode to an electrical power source of four to five volts. The gap between the anode 516 and the top of the aluminum 508 was about twenty millimeters. Surprisingly the voltage drop across the cell at five to fifteen amps was only that required to energize the cathode and anode. No voltage drop was associated with the disassociation of the alumina (electrolysis).

Experimental work has shown that $Al^{+++}$ alumina can be electrolyzed in molten fluoride baths at all temperatures above the melting point of aluminum (660° C.).

Prior art processes that use the Hall-Heroult electrolytic process depend upon maintaining a molten cryolite, $Na_3AlF_6$, salt at about 950° C. The raw material is alumina produced from bauxite using the Bayer process. The usual chemical used to extract the aluminum values from bauxite is caustic (NaOH), and thus chemically creates a negatively charged product, $Al(OH_4)^-$.

The carbo-electrolysis in a molten bath of three percent, by weight, $Al(OH_4)^-$ alumina, at about 950° C., will accumulate aluminum metal at the cathode. Oxygen at a carbon anode will produce carbon dioxide ($CO_2$) and some carbon monoxide (CO). This can be represented in a carbo-electrolytic reaction, where, $$2Al_2O_3 \xrightarrow{\text{electric}} 2Al_2 + 3O_2 \quad (1)$$

$$\text{and, } 3O_2 + 3C \xrightarrow{\text{power}} 3CO_2. \quad (2)$$

The oxygen ions $O^{--}$ combine with carbon from the anode to produce a negative voltage drop. Some of the oxygen is also used in a thermal combustion or burning of the carbon anode. In both cases, the carbon from the anode is consumed.

The theoretical voltage drop for equation (1) to produce the energy necessary to separate the aluminum and oxygen in the alumina is calculated from the energy of formation which is about 1600 kilojoule per gm mole of alumina. The voltage drop is about 2.2 volt. The energy liberated by the electrolytic production of $CO_2$, according to equation (2), is about 1.0 volt for one hundred percent conversion. It is generally accepted that fifty percent efficiency is achieved providing about 0.5 volt of the 2.2 volt necessary for the electrolysis in equation (1). The net voltage drop needed in equations (1) and (2) combined is believed to be approximately 1.7 volt.

If "carbon free" anodes are used, the energy of equation (2) is not produced, and oxygen is liberated at the anode without the formation of $CO_2$. The voltage drop is then about 2.2 volt. An overall voltage drop of five volts is required.

Generally, embodiments of the present invention adapt the usual Bayer process which starts as aluminum hydroxide in a wet cake. Pressure is applied and the temperature is raised to about 140° C. In the present invention, however, a stoichiometric amount of sulfuric acid and water are added to produce a basic aluminum sulfate ($3Al_2O_3 . 4SO_3 . 9H_2O$) in solution. Sulfuric, nitric, carbolyic, and other such acids can be used, and the examples herein show the use of sulfuric acid. The pressure is increased and the temperature is raised to above 180° C. to precipitate a family of basic aluminum sulfates, e. g., $6Al(OH)_3+4H_2SO_4 \rightarrow 3Al_2O_3 . 4SO_3 . 9H_2O+4H_2O$.

The basic aluminum sulfate is then separated from the mother liquor and washed to provide a feedstock of $Al^{+++}$ charged alumina for aluminum production. The feedstock is calcined at about 950° C. and produces cell-grade alumina. Such alumina from acidic solutions can be prepared from aluminum bearing raw materials such as bauxites, clays, and various other ores. See, D. J. O'Conner, *Alumina Extraction from Non-Bauxitic Materials*. Aluminum hydroxide is commercially produced for later calcination into cell grade alumina.

Solubilization of the aluminum hydroxide is carried out in two steps. Initially the sulfuric acid required to produce the basic aluminum sulfate is added at approximately 140° C. to some of the aluminum hydroxide producing an aluminum sulfate solution. The quantity of water included in the solution is adjusted to assure dissolution of the aluminum sulfate. Laboratory experience has shown this quantity to be roughly equivalent to that in the hydrate, $Al_2(SO_4)_3 . 14H_2O$. The remainder of the aluminum hydrate slurried with the required dilution water, is added to produce the required basic aluminum sulfate component mix at approximately 140° C. and a pH of approximately one. The temperature is raised under pressure to 170° C. to 230° C., preferably above 180° C., where a yield of approximately eighty percent precipitated basic aluminum sulfate is produced as a thirty percent slurry. After separation of the basic aluminum sulfate product from the mother liquor the latter is recycled to the beginning of the process. Basic aluminum sulfate thus produced is dried, dehydrated, and calcined at approximately 950° C. The product thus produced has a surface area (BET) of approximately eighty and has flowability characteristics suitable for feeding an aluminum smelter system.

The recycle liquor contains the unreacted components and water not removed with the basic aluminum sulfate product. This water is in excess of that required in the first solution step.

Therefore, the product slurry produced at approximately 1400 kilo-Pascals is reduced to atmospheric in a pressure let down step thus approximately balancing the water involved in basic aluminum sulfate production by removing approximately ten percent of the water as flashed vapor. The net excess water is then limited to that produced in the combustion of natural gas in the calcination of basic aluminum sulfate to produce alumina.

The addition of excess sulfuric acid, beyond the stoichiometric requirement, to the reactant mix can be used to influence the particle size distribution of the final positively charged alumina product. Any free acid remaining, up to ten percent of stoichiometric, is recycled. Extra acid is required to maintain a pH of one, and helps produce a particle size distribution that averages twenty microns. Such particle size gives good flowability and increased bulk density, which is an important advantage.

Process embodiments of the present invention convert aluminum hydroxide into a reactive alumina that is highly soluble in molten electrolytes above the melting point of aluminum, 660° C. Such alumina is suitable for use as catalyst as well as cell grade alumina for electrolysis of aluminum at temperatures greater than the melting point of aluminum, e.g., above 660° C.

Other processes using acids to extract the aluminum values from ores can be used including but not limited to bauxite, ores wherein "cell grade" positively charged alumina is produced with or without the need for caustic or the Bayer process. See, D. J. O'Conner, *Alumina Extraction from Non-Bauxitic Materials.*

Although the present invention has been described in terms of the presently preferred embodiments, it is to be understood that the disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

What is claimed is:

1. A process for smelting aluminum from alumina, the process comprising the steps of:

extracting positively charged $Al^{+++}$ alumina from a raw material including a compound of aluminum;

feeding said positively charged $Al^{+++}$ alumina into a molten fluoride salt electrolyte heated to approximately 750° C. to 950° C.;

maintaining a solution of said positively charged $Al^{+++}$ alumina at over four percent by weight of said molten fluoride salt electrolyte; and smelting aluminum metal from said solution of said positively charged $Al^{+++}$ alumina in said molten fluoride salt electrolyte by electrolysis utilizing an electric current applied to a gap between a cathode and an anode electrode.

2. The process of claim 1, wherein:

the step of smelting aluminum metal is such that a pair of anode electrodes are involved in said electrolysis and that are both comprised of carbon.

3. The process of claim 1, wherein:

the step of smelting aluminum metal is such that a pair of anode electrodes are involved in said electrolysis and neither of which comprise carbon.

4. The process of claim 1, further comprising the step of:

controlling any liquid aluminum by including a titanium diboride element in said cathode, and thereby allowing for a reduction in said gap during operation.

5. The process of claim 1, wherein:

the step of smelting is such that a system heat balance can be maintained with current densities up to two amps per square centimeter in said anode.

6. The process of claim 1, wherein:

the step of extracting positively charged $Al^{+++}$ alumina includes using sulfuric acid to convert aluminum hydroxide to a compound of a family of basic aluminum sulfates ($3Al_2O_3 \cdot 4SO_3 \cdot 9H_2O$), and then dehydrating and calcining such compound to an $Al^{+++}$ alumina.

7. The process of claim 1, wherein:

the step of extracting positively charged $Al^{+++}$ alumina includes using hydrochloric acid to convert aluminum hydroxide to a compound of a family of aluminum chloride hexahydrates $Al\ Cl_3 \cdot 6H_2O$ and calcining such compound to an $Al^{+++}$ alumina.

8. The process of claim 1, wherein:

the step of extracting positively charged $Al^{+++}$ alumina includes using nitric acid to convert aluminum hydroxide to a compound of a family of aluminum nitrate hydrates $Al\ (OH)_2(NO_3)$ and calcining such compound to an $Al^{+++}$ alumina.

9. The process of claim 1, wherein:

the step of extracting positively charged $Al^{+++}$ alumina includes using sulfuric acid and ammonia to convert aluminum hydroxide to a compound of a family of ammonium aluminum sulfates $NH_4Al_3(OH)_6(SO_4)_2$ and calcining such compound to an $Al^{+++}$ alumina.

10. The process of claim 1, wherein:

the step of extracting positively charged $Al^{+++}$ alumina includes using sodium or potassium hydroxides and sulfuric acid to convert aluminum hydroxide to a compound of a family of $NA_2$ or $K_2SO_4 3Al_2O_3 4SO_3 9H_2O$ and calcining such compound to an $Al^{+++}$ alumina after washing out the $NA_2$ or $K_2SO_4$.

11. The process of claim 1, wherein:

the step of extracting includes precipitating said positively charged $Al^{+++}$ alumina by leaching said raw material with an acid.

12. The process of claim 1, wherein:

the step of extracting includes precipitating said positively charged $Al^{+++}$ alumina by reacting said raw material with sulfuric acid at an elevated temperature and pressure for a residence time, such that a particular amount of acid and a particular residence time are used to control a particle size distribution of said positively charged $Al^{+++}$ alumina.

13. The process of claim 1, further comprising the step of:

circulating said molten fluoride salt electrolyte around said anode.

14. The process of claim 1, wherein:

the step of feeding is such that said molten fluoride salt electrolyte is heated to approximately 750° C. and thereby provides for a reduced burning of any carbon included in said anode electrode.

15. The process of claim 1, wherein:

the step of feeding is such that said molten fluoride salt electrolyte is heated to approximately 750° C. and said positively charged $Al^{+++}$ alumina is maintained at over four percent solution, by weight.

16. A process for producing positively charged $Al^{+++}$ alumina from ore bodies containing aluminum, the process comprising the steps of:

reacting a slurry of aluminum hydroxide, water, and acid at an elevated temperature and pressure for a residence time;

reducing said pressure applied to said slurry to reduce said temperature to about 100° C.;

separating any solids from any liquids in said slurry and returning said liquids to the step of reacting;

washing said solids and returning any liquids to the step of reacting;

drying said solids;

calcinating said solids after drying and at a temperature of about 950° C. to produce a positively charged $Al^{+++}$ alumina with a particular particle size distribution; and recirculating any acids removed from said solids during the steps of drying or calcinating to the step of reacting through an acid plant recovery.

17. The process of claim 16, wherein:

the step of reacting includes the use of sulfuric acid and an elevated temperature of about 150° C., and then elevating the pressure to about 1400 kilo-Pascals and a temperature around 200° C. for a residence time of about two minutes;

wherein, said particle size distribution has an average size of about twenty microns.

* * * * *